US005983412A

United States Patent [19]

Lordahl

[11] Patent Number: 5,983,412

[45] Date of Patent: Nov. 16, 1999

[54] TOILET TANK BALL FLAPPER AND PLASTIC CHAIN ASSEMBLY FORMED AS A UNITARY STRUCTURES

[76] Inventor: Var E. Lordahl, 1571 Schaeffer, Long Grove, Ill. 60047

[21] Appl. No.: 08/370,851

[22] Filed: Jan. 10, 1995

Related U.S. Application Data

[63] Continuation of application No. 08/158,449, Nov. 29, 1993, abandoned.

[51] Int. Cl.[6] ..... F03D 1/35

[52] U.S. Cl. ..... 4/393; 4/404; 4/412

[58] Field of Search ..... 4/324, 325, 378, 4/392, 393, 403, 404, 412; 206/820

[56] References Cited

U.S. PATENT DOCUMENTS

| | | | |
|---|---|---|---|
| 2,985,291 | 5/1961 | Schoepe et al. | 206/820 |
| 3,943,577 | 3/1976 | Woolf et al. | 4/325 X |
| 4,189,795 | 2/1980 | Conti et al. | 4/403 X |
| 4,499,616 | 2/1985 | Johnson | 4/393 |
| 4,698,859 | 10/1987 | Freed | 4/393 |
| 5,153,948 | 10/1992 | Smith et al. | 4/394 X |

*Primary Examiner*—Robert M. Fetsuga
*Attorney, Agent, or Firm*—Kajane McManus

[57] ABSTRACT

The toilet tank ball flapper and chain assembly is formed as a unitary article of manufacture, with the chain being integrally molded to lie along the perimeter of the base plate of the flapper and being releasably engaged thereto by a plurality of break away nubs.

2 Claims, 1 Drawing Sheet

TOILET TANK BALL FLAPPER AND PLASTIC CHAIN ASSEMBLY FORMED AS A UNITARY STRUCTURES

CROSS REFERENCE TO RELATED APPLICATIONS

The present application is a continuation of U.S. patent application Ser. No. 08/158,449 filed on Nov. 29, 1993 and entitled Toilet Tank Ball Flapper and Plastic Chain Assembly Formed as a Unitary Structure, now abandoned.

BACKGROUND OF THE INVENTION

1. Field of the Invention

The present invention relates to a toilet tank ball flapper and chain therefor which are formed as a unitary structure.

2. Description of the Prior Art

Heretofore, a toilet tank ball flapper has been manufactured as a structure either attached to, or unattached from, a metal, plastic or rubber chain used to engage the ball end of the flapper to an actuator or activating lever therefor.

Such separate forming of the structures has several drawbacks.

One such drawback found when the two parts are separately molded, is complicated packaging. In this respect, the separate chain must be accommodated within the package with excess packaging material. Further, the packaging has an unaesthetic appearance, with a chain usually being loosely received in the package.

A further, and even more expensive drawback, especially where the chain is made of plastic or stainless steel, is the requirement for a further die for making the chain as a separate structure. The extra costs in time and money incurred in this two step manufacturing process, as well as in the packaging, will be readily apparent to one skilled in the art.

As will be described in greater detail hereinafter, the instant flapper and integral chain assembly formed as unitary structure overcomes the drawbacks described above.

SUMMARY OF THE INVENTION

According to the invention there is provided as an article of manufacture, a toilet tank ball flapper molded integral with a lift chain therefor, creating a unitary molded structure.

Further according to the invention there is provided a toilet tank ball flapper and chain assembly created as a unitary structure which additionally allows for the installation of a separate metal or other chain thereto, if one so desires.

DESCRIPTION OF THE PREFERRED EMBODIMENT

Figure 1:
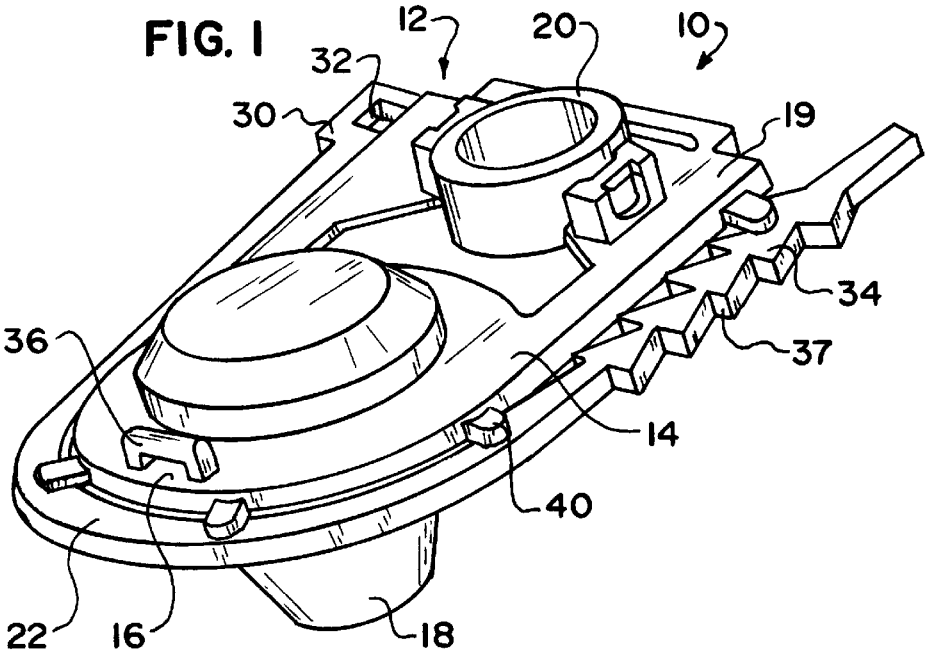
FIG. 1 is a perspective view of the toilet tank ball flapper and chain formed as a unitary structure in accordance with the teachings of the present invention.
Figure 2:
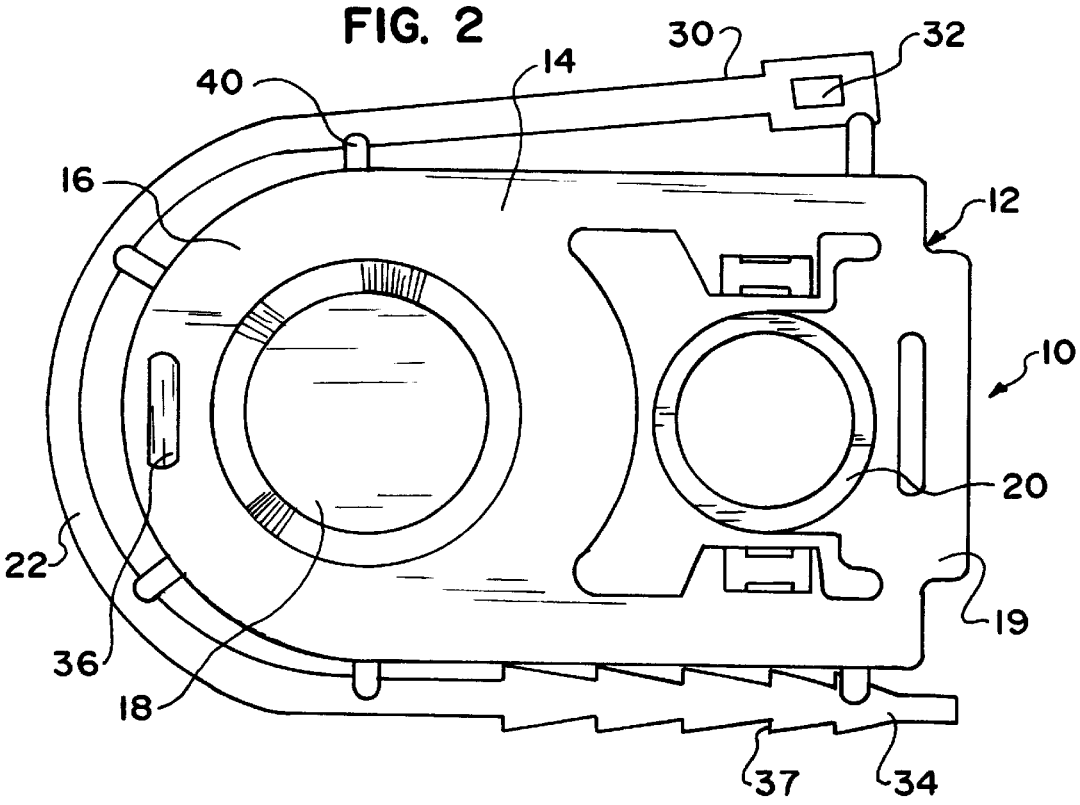
FIG. 2 is a top plan view of the structure of FIG. 1.

Referring now to the drawings in greater detail, there is illustrated therein an article of manufacture, namely a toilet tank ball flapper and chain assembly formed as a unitary structure in accordance with the teachings of the present invention and generally identified by the reference numeral 10.

As is known, the flapper 12 includes a base plate or frame 14, which at one end 16 thereof engages a ball 18 used to control flow of water into the toilet bowl (not shown). Another, opposite end 19 is provided which, through a plurality of engagement members or collars 20, the plurality making the flapper 10 substantially universal.

As described above, a lifter chain, 22 either of plastic, rubber or metal, is typically provided for engaging the ball end 16 of the base plate 14 to an activating lever (not shown) for same which raises the ball 18 from within a seat (not shown), such lifter chain 22 typically being manufactured as a separate structure.

As shown in the Figures, according to the present invention, the lifter chain 22, may now be molded integral with the flapper 12.

In this respect, it will be seen that the chain 22 is an elongate, planar member 22 having one end 30 which has an opening 32 therein and having a second end 34 which, after separation from the base plate 14, may be functionally attached thereto by sliding the end 34 through the opening 32 after being passed under an elevated engagement clip 36 provided on the base plate 14, at end 16 thereof.

The second end 34 may be provided with any configuration which will allow for its engagement to an activating lever.

In the disclosed embodiment, it is shown as barbed, with the barbs 37 acting to retain engagement with the activating lever.

It will be understood that the base plate 14 of the flapper 12 is made of a flexible thermal plastic rubber to create a sturdy support for the ball 18. This thermal plastic rubber may be injection molded into the desired configuration and, as shown, may also be used in forming the chain 22.

As shown, the chain 22 may be created as an extension of the base plate 14, lying coplanar with the base plate 14 and being releasably engaged thereto by a plurality of break away nubs 40. Creating the flapper and chain assembly 10 as a unitary structure is seen to produce an aesthetically pleasing article of manufacture which significantly reduces, if not altogether eliminates, the need for significant packaging time and material to accommodate a loosely enclosed chain.

Further, inasmuch as the assembly 10 is manufactured as a unitary structure, there is a saving in tooling required, as well as in time and energy expended in combining a chain with each flapper prior to packaging of same.

Also, it has been found through empirical testing that a decreased mold pressure is effective in forming the assembly 10 when the chain 22 is framed around the perimeter of the base plate 14 as shown, increasing the useful life of the die used in molding the assembly 10.

As described above, the assembly 10 of the present invention provides a number of advantages, some of which have been described above and others of which are inherent in the invention. Also, modifications may be proposed to the assembly 10 without departing from the teachings herein. Accordingly the scope of the invention is only to be limited as necessitated by the accompanying claims.

I claim:

1. As an article of manufacture, a toilet tank ball flapper molded integral with a lift chain therefor, the flapper including a planar base plate which supports a ball of the flapper, said base plate having a periphery, said lift chain being an elongated planar plastic member, framed about the periphery of the base plate, said base plate being engaged to said chain by a plurality of break away nubs extending between the plate and the chain.

2. A toilet tank ball flapper and chain assembly wherein said flapper includes a planar base plate which supports a ball of the flapper, said base plate having a periphery, and said lift chain being an elongate planar member, and being engaged to said base plate periphery by a plurality of break away nubs extending between the plate and the chain.

* * * * *